US005201095A

United States Patent [19]

Choi

[11] Patent Number: 5,201,095

[45] Date of Patent: Apr. 13, 1993

[54] MOTOR CONTROLLING APPARATUS FOR A VACUUM CLEANER

[75] Inventor: Soo Y. Choi, Suweon, Rep. of Korea

[73] Assignee: SamSung Electronics Co., Ltd., Suwon, Rep. of Korea

[21] Appl. No.: 724,592

[22] Filed: Jul. 1, 1991

[30] Foreign Application Priority Data

Jul. 28, 1990 [KR] Rep. of Korea ..... 90-11165

[51] Int. Cl.[5] ..... A47L 9/28

[52] U.S. Cl. ..... 15/339; 15/319; 15/353; 55/213

[58] Field of Search ..... 15/353, 319, 339; 55/212, 213, 215

[56] References Cited

U.S. PATENT DOCUMENTS

| | | | |
|---|---|---|---|
| Re. 26,950 | 9/1970 | Hays | 15/321 |
| 961,816 | 6/1910 | Squier | 15/321 |
| 1,621,596 | 3/1927 | Minuth | 15/314 |
| 3,048,875 | 8/1962 | Bottinelli et al. | 15/353 X |
| 3,180,071 | 4/1969 | Nolte | 55/213 |
| 3,748,834 | 7/1973 | Ruby | 55/213 |
| 4,123,818 | 11/1978 | Hurwitz | 15/339 X |
| 4,691,407 | 9/1987 | Sloan et al. | 15/339 |
| 4,726,060 | 10/1988 | Chang | 15/339 |

FOREIGN PATENT DOCUMENTS

| | | | |
|---|---|---|---|
| 60470 | 5/1912 | France | 15/375 |

*Primary Examiner*—Chris K. Moore

*Attorney, Agent, or Firm*—Robert E. Bushnell

[57] ABSTRACT

A motor controlling apparatus for a vacuum cleaner comprising a cylinder disposed on the base of the vacuum cleaner, a spring base mounted at lower portion of the cylinder and provided with an aperture communicating with the hole of the base, a spring mounted on the spring base, a piston biased by the spring, a cylinder head seal-tightly contacting with the piston and provided with a hole communicating with the atmosphere, and a limit switch contacting with the piston by means of an actuating rod penetrating the hole of the cylinder head in order to automatically turn off circuit of drive motor. The present invention can provide a motor controlling apparatus which can automatically open the circuit of the drive motor by means of the limit switch capable of being opened by the actuating rod as the piston moves downward resulting from rising of degree of vacuum inside the collection tank of the vacuum cleaner such as due to a clogging of the suction port and the filter pocket of the tank.

8 Claims, 3 Drawing Sheets

MOTOR CONTROLLING APPARATUS FOR A VACUUM CLEANER

BACKGROUND OF THE INVENTION

1. Field of the Invention

The present invention relates to a vacuum cleaner capable of washing floors, carpets and the like by using washing water containing detergent, and more particularly to a motor controlling apparatus for the vacuum cleaner, the motor controlling apparatus capable of preventing overheating of a motor occurring due to clogging of a filter pocket and a suction port of the vacuum cleaner.

2. Description of the Prior Art

Generally, a known vacuum cleaner capable of washing floors, carpets and the like by using washing water comprises a vacuum pump as a suction part, the vacuum pump having a brush enclosed therein, and a reservoir containing washing water with detergent. In cleaning operation, the known cleaner can sprinkle the floors, carpets with washing water from the reservoir then wash and clean them, and thereafter, suck sewage after washing and cleaning. However, there has been a disadvantage of overheating of the motor of the vacuum cleaner occurring due to clogging of a filter and a suction port with dust.

U.S. Pat. No. 4,463,473 discloses a vacuum cleaner comprising a filter, a fan motor having a suction region disposed downstream of the filter, bypass air passage vented directly to the atmosphere and connected to the suction region of the fan motor in bypassing relation to the filter, and a pressure-responsive valve for opening or closing the bypass air passage in response to changes in pressure in the suction region under a predetermined value, the change in pressure being caused by dust collected within the vacuum cleaner. The bypass air passage includes an alarm sound producing unit actuated by air flow through the bypass air passage and a closure device mounted for manual actuation by the user to selectively prevent actuation of the sound unit by restricting airflow therethrough.

U.S. Pat. No. 4,218,805 discloses an apparatus for cleaning floors, carpets and the like comprising a movable container adapted for the collection of a liquid and including an annular-shaped side wall and a suction inlet connected to the container, an inner wall surrounding the suction inlet and a reservoir disposed between said inner wall and the annular side wall and adapted for containing cleaning liquid. The apparatus is also provided with collection part for collecting the cleaning liquid sucked from the inner wall by sucking air containing the cleaning liquid from the floors and the like by means of a fan, and colliding this air with the annular side wall and then changing the flowing direction of the air. A valve having an opening, through which the air is forced to enter said reservoir in order to provide cleaning liquid through a slim pipe, and also adapted for preventing float and overflow in the reservoir is also provided.

However, the above-mentioned embodiments of a known vacuum cleaner do not teach an apparatus for controlling the motor from overheating due to clogging of the suction port and the filter with dust.

Therefore, there is the drawback of the danger of overheating the motor of the known vacuum cleaner occurring due to clogging of the suction port and the filter.

SUMMARY OF THE INVENTION

It is, therefore, an object of the present invention to provide a motor controlling apparatus for a vacuum cleaner, which is capable of shutting off electric power applied to a motor of the vacuum cleaner when there is overheating of the motor occurring due to clogging of a suction port and a filter pocket of the vacuum cleaner with dust and dirt, thereby preventing the motor from overheating and also solving the above-mentioned drawback encountered in the known vacuum cleaner.

It is another object of the present invention to provide a switch for a vacuum cleaner which is capable of being turned on or turned off in accordance with the pressure grade inside a water and dust collection tank of the vacuum cleaner.

In accordance with the present invention, the above-mentioned objects can be accomplished by providing a motor controlling apparatus for a vacuum cleaner, the cleaner having a dual purpose of dry suction cleaning and water extraction cleaning and comprising a collection tank provided with a suction port for collecting dust and washing water, a filter pocket mounted to an inner flange of the collection tank, a drive motor adapted for providing a drive motor, and a base provided with a center opening and a hole, the hole formed at periphery of the base away from the center opening, thereby allowing the center opening and the hole to communicate with the suction port by way of the inside of the collection tank, the motor controlling apparatus comprising the base provided with the center opening and the hole, a cylinder disposed on the hole of the base, a spring base mounted at a lower portion of the cylinder and provided with an aperture communicating with the hole of the base, a spring mounted on the spring base, a piston biased by the spring, a cylinder head mounted at upper portion of said cylinder, tightly sealed by the piston and provided with a hole communicating with the atmosphere, and a limit switch contacting with the piston by means of an actuating rod penetrating the hole of the cylinder head in order to automatically turn off drive motor by automatically open a circuit of the drive motor when the limit switch which has been opened by the actuating rod as the piston moves downward resulting from a decrease in pressure inside said collection tank such as due to a clogging of said suction port and said filter pocket of said tank.

BRIEF DESCRIPTION OF THE DRAWINGS

The above and other objects, features and other advantages of the present invention will be more clearly understood from the following detailed description taken in conjunction with the accompanying drawings, in which:

FIGS. 3 are circuit diagrams of the motor controlling apparatus of FIG. 2, respectively: in which, FIG. 3A shows operation of the motor controlling apparatus; and FIG. 3B shows relay operation of the motor controlling apparatus.

DETAILED DESCRIPTION OF THE PREFERRED EMBODIMENTS

Figure 1:
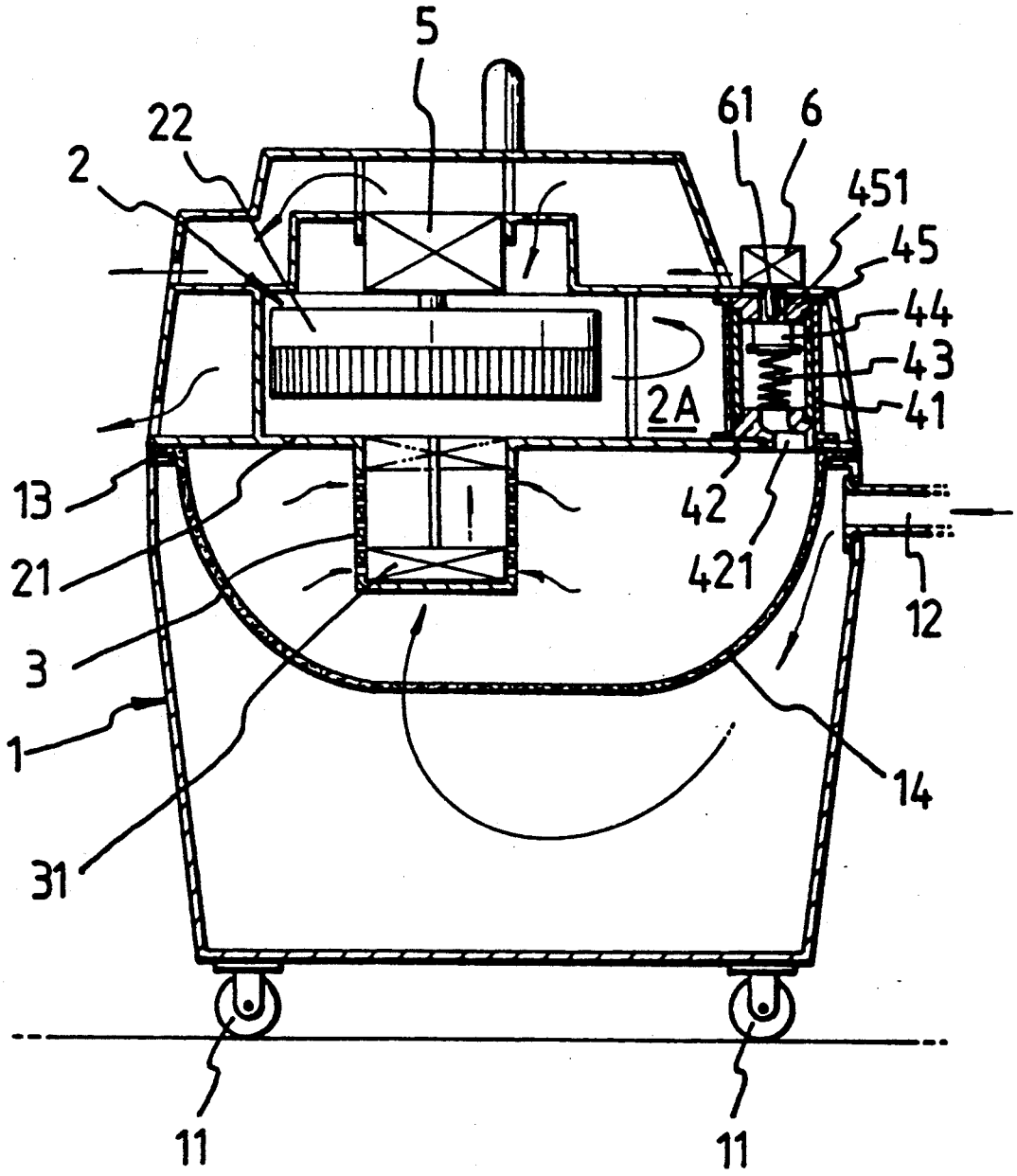
FIG. 1 is an elevational sectioned view showing a vacuum cleaner, having a dual purpose of dry suction cleaning and water extraction cleaning, provided with a motor controlling apparatus in accordance with the present invention.
Figure 2:
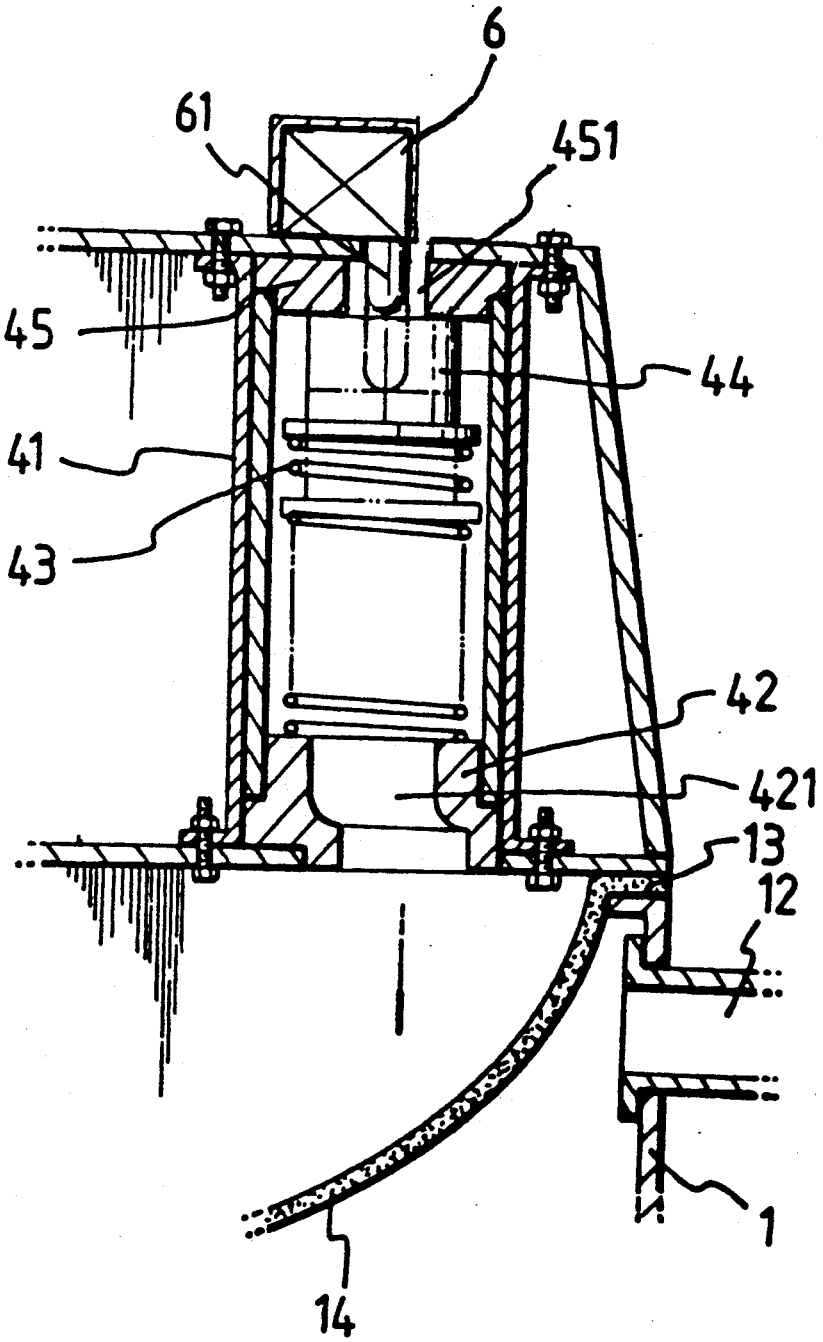
FIG. 2 is a partially enlarged sectioned view showing the motor controlling apparatus of FIG. 1.

Referring now to FIGS. 1 and 2 are an elevational sectioned view showing a vacuum cleaner having a dual purpose of dry suction cleaning and water extraction cleaning, provided with a motor controlling apparatus in accordance with the present invention and a partially enlarged sectioned view showing the motor controlling apparatus of FIG. 1, respectively. The vacuum cleaner generally comprises a collection tank 1 for collecting dust and water and rollers 11 each rotatably mounted under the collection tank 1.

The collection tank 1 has an internally extending flange 13 at uppermost periphery thereof, and a suction port 12 mounted at an optimum portion of side wall of the tank 1 near the flange 12. The suction port 12 is connected with a floor nozzle (not shown) by means of a flexible hose 12*a*, which floor nozzle will be located at the object to be cleaned and suck dirt and sewage therefrom by means of the suction power provided by the vacuum cleaner in order to clean and wash the object.

There is provided a filter pocket 14 which is sealed-tightly and elastically supported at its periphery between the flange 13 of the collection tank 1 and a base 21 of a vacuum pump 2 in order to provide an almost hemispherical recess inside the collection tank 1.

The vacuum pump 2 is disposed on the base 21, which base 21 has a circular air suction opening integrally formed at an optimum portion near the center thereof in order to form a lower center portion of the vacuum pump 2. The air suction opening is provided with a float container 3 extending downwardly from the periphery of the suction opening in order to protrude inside the collection tank 1, and having a plurality of inlet holes formed at its side wall and also enclosing a float 31 movably mounted thereto so as to move upward and downward along a vertical guide rod.

Therefore, the float container 3 will be disposed at an almost center portion of the base 21 above the filter pocket 14.

In addition, the vacuum cleaner is provided on the air suction opening in the base 21 with a pump casing for providing space enclosing a pump wheel 22 and a drive motor 5, which pump wheel 22 is concentrically disposed with the air suction opening of the base 21 and coaxially mounted to the drive motor 5, and also functions to exhaust air having been sucked through a passage comprising the side wall of the vacuum cleaner and the float container 3.

On the other hand, there is provided a motor controlling apparatus disposed at the periphery of the vacuum cleaner away from center of the base 21 of the pump 22 and comprising a limit switch and control device for controlling the operation of the limit switch, which motor controlling apparatus is the subject of the present invention.

The base 21 is, at the lower position of the motor controlling apparatus, provided with a hole 421 and a cylinder 41, the cylinder 41 created upwardly on said portion of the base 21 including the hole 421, the hole 421 communicates with the collection tank 1.

The cylinder 41 includes dual side wall and, at the lower portion thereof, a spring base 42 which is provided with an aperture 421′ communicating with the hole 421 and adapted for supporting a compression coil spring 43 is the coil spring 43 adapted to bias a piston 44 upwardly. The piston 44 is seated on the top of the spring 43 and biased upwardly by restoring force of the compression coil spring 43 so that said piston 44 may, in the normal case, always seal-tightly with the under surface of a cylinder head 45.

The cylinder head 45 is disposed at upper portion thereof in order to cover the cylinder 41 and provided with a hole 451 at the center thereof. Also, there is provided a limit switch 6 mounted on the cylinder head 45 and including an actuating rod 61 extending downwardly from the limit switch 6 in order to penetrate the hole 451 of the cylinder head 45 and contact at the lowermost end thereof with the upper surface of the piston 44 which is biased upwardly. Additionally, the hole 451 makes the inside of the cylinder 41 communicate with the atmosphere. However, the piston 44 always tightly seals with the under surface of the cylinder head 45 as above-mentioned. Therefore, piston 44 has, in normal case, an upper surface exposed to the atmosphere but also cuts off the inside of the cylinder 41 from the atmosphere.

Clogging of the suction port 12 and the filter pocket 14 by dirt or due to a high water level of the washing water inside the collection tank 1 over a predetermined level, results in a decrease in pressure inside the collection tank 1.

At this time, the restoring power of the compression coil spring 43 biasing the piston 44 upwardly will be offset by negative pressure inside the collection tank 1 so that piston 44 may be forced downwardly, thereby causing the actuating rod 61 of the limit switch 6 to be forced downwardly, as represented at dotted line in FIG. 2.

Figure 3:
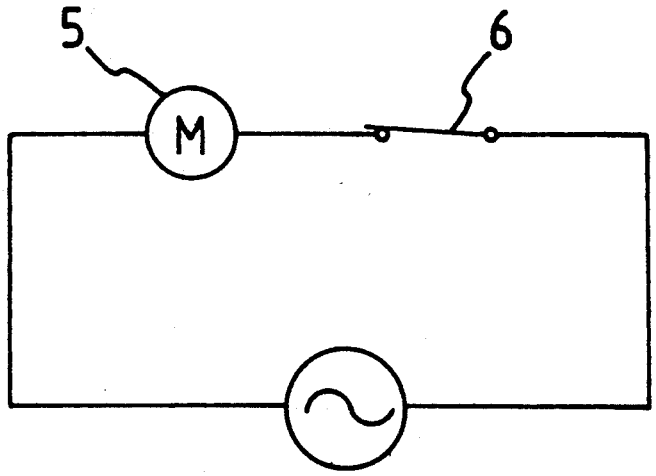
Figure 3:
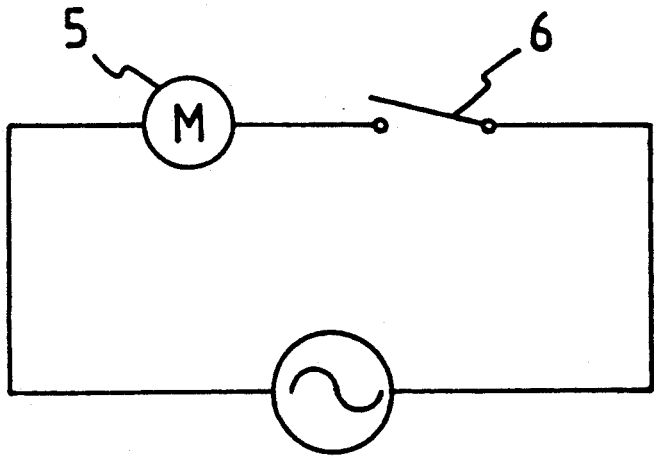

In result, the limit switch 6 is switched from its closed state shown in FIG. 3A, in which closed state the drive motor 5 drives, to its open state shown in FIG. 3B, resulting in stopping the drive motor 5.

Therefore, it will be known that the present invention can provide a vacuum cleaner capable of preventing a waste of electric power, a waste of manpower and a motor trouble by stopping the drive motor 5 by means of the motor controlling apparatus when there is clogging of the suction port and the filter pocket of the vacuum cleaner.

In addition, the limit switch 6 can use any type of conventional limit switch irrespective of the types thereof, an electronic type of limit switch which can electronically open the circuit of the drive motor, or a mechanical type of limit switch which can mechanically change the circuit of the drive motor.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A motor controlling apparatus for a vacuum cleaner comprising:

a collection tank having an open upper portion and being provided with a suction port for collecting dust and washing water through said suction port;

a base member for covering said open upper portion, said base member adapted to seal a cavity formed in said collection tank, and provided with a base member opening formed in said base member and communicating said cavity with the outside atmosphere;

means for sealing said base member opening, said sealing means comprising a float and a float housing, said float housing provided under said base member opening and protruding downwardly from said base member and having a side wall with a plurality of holes, said float enclosed within said float housing and adapted for opening and closing said base member opening in response to said washing water reaching a predetermined level;

blowing means disposed over said base member opening and adapted for sucking air from said collection tank through said base member opening and exhausting said air to the outside atmosphere;

a cylinder mounted on said base member, said cylinder provided with an upper hole and a lower hole formed in said cylinder, said upper hole for communicating the outside atmosphere with an inside of said cylinder, said lower hole communicating said cavity with the inside of said cylinder;

a piston provided in said cylinder, said piston capable of being displaced upward and downward in response to changes in the pressure level inside said collection tank in order to open and close said upper hole of the cylinder;

limit switch means adapted to turn off said blowing means in response to a displacement in one direction of said piston; and an elastic member provided in said cylinder for urging said piston against said upper hole.

2. A wet and dry vacuum cleaner comprising:

a collection tank having an open upper portion and provided with a suction port to allow dust and washing water to pass into the collection tank;

a base member for sealably covering said open upper portion to form a cavity within the collection tank;

blowing means disposed on said base member for drawing air from said cavity and exhausting said air; and a pressure regulator comprising:

a portal communicating with the cavity and the atmosphere;

sealing means for covering the portal;

urging means for urging the sealing means over the portal with an urging force; and limit switch means for cutting off power to the blowing means when the sealing means is urged away from the portal;

wherein when pressure within the cavity falls below a predetermined level relative to atmospheric pressure a pressure differential between the cavity and an atmosphere overcomes the urging force, thereby moving the sealing means away from the portal.

3. The wet and dry vacuum cleaner, according to claim 2, further comprising:

filter means dividing the cavity into a upper portion and a lower portion, joining with the collection tank at a junction between the collection tank and the base member for filtering air sucked in by the blowing means.

4. The wet and dry vacuum cleaner, according to claim 3, wherein the upper portion is substantially hemispherical.

5. The wet and dry vacuum cleaner, according to claim 2, the pressure regulator further comprising:

a cylindrical housing mounted on the base member and communicating with the cavity through hole formed in the base member, the portal being formed in an upper portion of said cylinder, wherein the sealing means is a piston provided within the cylinder, said piston capable of displacing downward thereby opening the portal.

6. The wet and dry vacuum cleaner, according to claim 2, further comprising means for closing a base member opening formed in said base member, said blowing means sucking air from said cavity through said base member opening, saic closing means comprising a float adapted for opening and closing said base member opening in response to said washing water reaching a predetermined level.

7. The wet and dry vacuum cleaner, according to claim 6, said closing means further comprising a float housing extending downwardly from a bottom of said base member opening and having a side wall with a plurality of holes, said float being enclosed within said float housing.

8. A vacuum cleaner having a motor controlling apparatus, said vacuum cleaner comprising:

a collection tank for holding collected material;

suction means for drawing the collected material into said collection tank; and means for automatically stopping an electric driving member of said suction means, said automatic stopping means disposed on a base member, said base member disposed over said collection tank, said automatic stopping means comprising:

a hollow cylinder, a spring base disposed in a lower portion of said cylinder and provided with a first aperture providing a passage between an inside of said collection tank and an inside of said hollow cylinder, an expansion spring mounted on said spring base, a cylinder head disposed in an upper portion of said hollow cylinder and provided with a second aperture providing a passage between the inside of said hollow cylinder and an ambient atmosphere;

a piston disposed between said cylinder head and said spring and urged into a sealing contact with said cylinder head by said expansion spring, said piston sealably sliding on an inner wall of said hollow cylinder, and a limit switch having a moving rod extending through the second aperture of said cylinder head to contact with said piston, said limit switch for stopping said electric driving member when a pressure differential between said collection tank and said ambient atmospheric overcomes the urging force of said expansion spring thereby displacing said piston downward.

* * * * *

UNITED STATES PATENT AND TRADEMARK OFFICE

CERTIFICATE OF CORRECTION

PATENT NO. : 5,201,095
DATED : April 13, 1993
INVENTOR(S) : Soo-Young Choi

It is certified that error appears in the above-indentified patent and that said Letters Patent is hereby corrected as shown below:

Column 1, Line 50, after "between" change "said" to --the--;

Column 2, Line 40, change "said" to --the--;

Column 4, Line 4, change "said" to --the--:

Signed and Sealed this

Twenty-second Day of April, 1997

Bruce Lehman

*Attest:*

BRUCE LEHMAN

*Commissioner of Patents and Trademarks*

*Attesting Officer*